US010744519B1

(12) United States Patent
Lim

(10) Patent No.: US 10,744,519 B1
(45) Date of Patent: Aug. 18, 2020

(54) DISCHARGE DEVICE FOR DISCHARGING LIQUID CONTENT IN TUBE CONTAINER IN DROPLET FORM

(71) Applicant: Jong Su Lim, Pocheon-si (KR)

(72) Inventor: Jong Su Lim, Pocheon-si (KR)

( * ) Notice: Subject to any disclaimer, the term of this patent is extended or adjusted under 35 U.S.C. 154(b) by 0 days.

(21) Appl. No.: 16/795,883

(22) Filed: Feb. 20, 2020

(30) Foreign Application Priority Data

May 31, 2019 (KR) ..... 10-2019-0064541

(51) Int. Cl.
*B05B 1/02* (2006.01)
*B65D 83/00* (2006.01)

(52) U.S. Cl.
CPC ..... *B05B 1/02* (2013.01); *B65D 83/0094* (2013.01)

(58) Field of Classification Search
CPC ..... B65D 47/2018; B65D 47/2025; B65D 47/2031; B65D 47/2081; B05C 5/0225; B05C 5/0237
See application file for complete search history.

(56) References Cited

U.S. PATENT DOCUMENTS 5,105,993 A * 4/1992 La Haye ..... A61F 9/0008 210/321.89
5,373,972 A * 12/1994 Bystrom ..... A61F 9/0008 222/212
6,672,479 B2 * 1/2004 Shiraishi ..... B65D 23/02 222/105
6,708,850 B2 * 3/2004 Uetake ..... A61F 9/0008 222/105
8,690,019 B2 * 4/2014 Defemme ..... B65D 51/1616 222/189.11
9,352,897 B2 * 5/2016 Hoshino ..... B65D 47/40
10,207,844 B2 * 2/2019 Thukral ..... B65D 47/263
10,308,403 B2 * 6/2019 Hashimoto ..... B65D 47/2081
10,507,958 B2 * 12/2019 Hashimoto ..... B65D 83/0055
2002/0153386 A1 * 10/2002 Uetake ..... B65D 47/2018 222/1

(Continued)

FOREIGN PATENT DOCUMENTS

KR 20-0310084 Y1 4/2003
KR 10-1448829 B1 10/2014

(Continued)

*Primary Examiner* — Paul R Durand
*Assistant Examiner* — Randall A Gruby
(74) *Attorney, Agent, or Firm* — Novick, Kim & Lee, PLLC; Jae Youn Kim

(57) ABSTRACT

A discharge device for discharging a liquid content in a tube container in a droplet form, in which a tube main body; a tube head including an integrated discharge rod; a regulating unit provided in an assembly space of the tube head; and a valve unit are sequentially assembled, so that a uniform amount of the liquid content is discharged in the droplet form through a narrow passage and a wide passage, and then through the wide passage and a narrow passage when the liquid content is discharged in the droplet form in a process of discharging the liquid content through a discharge passage by a pressure applied by a user. Accordingly, an appropriate amount of the liquid content is smoothly used. Particularly, long-term use of the liquid content is ensured, and the uniform amount of the liquid content is accurately discharged in the droplet form.

2 Claims, 3 Drawing Sheets

(56) References Cited

U.S. PATENT DOCUMENTS

| | | | | |
|---|---|---|---|---|
| 2004/0050881 | A1* | 3/2004 | Deussen | B65D 47/18 222/420 |
| 2011/0144598 | A1* | 6/2011 | Mihashi | B65D 47/18 604/295 |
| 2012/0305607 | A1* | 12/2012 | Geiger | B65D 47/2025 222/494 |
| 2013/0026196 | A1* | 1/2013 | Essebaggers | B65D 47/2068 222/482 |
| 2014/0144938 | A1* | 5/2014 | Kakuta | B65D 47/2093 222/105 |
| 2014/0263443 | A1* | 9/2014 | Furusawa | B65D 47/2031 222/105 |
| 2015/0328653 | A1 | 11/2015 | Minnette et al. | |
| 2018/0111724 | A1* | 4/2018 | Sakimura | B65D 41/185 |
| 2019/0291930 | A1* | 9/2019 | Sakimura | B65D 1/02 |
| 2019/0308780 | A1* | 10/2019 | Baumann | B65D 47/18 |
| 2020/0009548 | A1* | 1/2020 | Duquet | B01L 3/0265 |

FOREIGN PATENT DOCUMENTS

| | | | |
|---|---|---|---|
| KR | 10-1554189 | B1 | 9/2015 |
| KR | 10-1609993 | B1 | 4/2016 |
| KR | 10-2019-0033359 | A | 3/2019 |

* cited by examiner

DISCHARGE DEVICE FOR DISCHARGING LIQUID CONTENT IN TUBE CONTAINER IN DROPLET FORM

BACKGROUND OF THE INVENTION

1. Field of the Invention

The present invention relates to a discharge device for discharging a liquid content in a tube container in a droplet form, and more particularly, to a discharge device for discharging a liquid content in a tube container in a droplet form, capable of discharging a uniform amount of the liquid content in the droplet form through a narrow passage and a wide passage, and then through the wide passage and a narrow passage when the liquid content is discharged in the droplet form in a process of discharging the liquid content through a discharge passage by a pressure applied by a user.

2. Description of the Related Art

In general, a liquid content filled in a tube container having flexibility is typically discharged through an exhaust hole for use as a pressure is applied to the tube container by a user.

However, the liquid content is discharged in a stream form in the process of discharging the liquid content through the exhaust hole by the pressure applied to the tube container, so that it is quite inconvenient to use an appropriate amount of the liquid content, which is considered necessary.

In order to solve such a problem, conventionally, a technique of discharging the liquid content in a droplet form to use an appropriate amount of the liquid content has been proposed.

First, as disclosed in Korean Utility Model Registration Publication No. 20-0310084 (hereinafter referred to as "Related art document 1"), there have been proposed techniques such as a tube-type cosmetic container for discharging a liquid content in a droplet form, in which an intermediate outlet tube having a linear cutout portion is installed in a discharge tube of the tube-type cosmetic container to discharge a stream-form discharge target content in the droplet form.

In addition, as disclosed in Korean Patent Registration Publication No. 10-1554189 (hereinafter referred to as "Related art document 2"), there have been proposed techniques such as a tube-type cosmetic container for discharging a liquid content in a droplet form, capable of discharging the liquid content in the droplet form through a simple content discharging structure that gradually widens from a bottom to a top thereof.

In addition, as disclosed in Korean Unexamined Patent Publication No. 10-2019-0033359 (hereinafter referred to as "Related art document 3"), there have been proposed techniques such as a discharge device for discharging a liquid content in a tube container in a droplet form, capable of easily discharging the liquid content in the droplet form through a narrow passage and a wide passage, and then through the wide passage and a narrow passage when discharging the liquid content by opening and closing an exhaust hole by a pressure applied by a user.

DOCUMENTS OF RELATED ART

Patent Documents (Patent document 1) Korean Utility Model Registration Publication No. 20-0310084

(Patent document 2) Korean Patent Registration Publication No. 10-1554189

(Patent document 3) Korean Unexamined Patent Publication No. 10-2019-0033359

SUMMARY OF THE INVENTION

However, Related art document 1 has disadvantages that the technical configuration is quite complicated, and the assembly is quite inconvenient.

Related art document 2 has disadvantages that the liquid content may be easily deteriorated due to external air introduced through a discharge passage after the liquid content is discharged through the discharge passage in the droplet form.

Related art document 3 has been provided to compensate for the disadvantage of Related art document 2, which allows the external air to be introduced. However, Related art document 3 has disadvantages that the liquid content may not be smoothly discharged in a uniform amount in the droplet form when the liquid content is discharged in the droplet form.

To solve various problems in related art documents described above, a specific technical object of the present invention is to provide a discharge device for discharging a liquid content in a tube container in a droplet form, capable of discharging a uniform amount of the liquid content in the droplet form through a narrow passage and a wide passage, and then through the wide passage and a narrow passage when the liquid content is discharged in the droplet form in a process of discharging the liquid content through a discharge passage by a pressure applied by a user.

Another specific technical object of the present invention is to discharge the liquid content in a more uniform amount when the liquid content is discharged in the droplet form.

To achieve the specific technical objects described above, according to a specific solution of the present invention, there is provided a discharge device for discharging a liquid content in a tube container in a droplet form, the discharge device including: a tube main body having flexibility and filled with the liquid content; a tube head including an integrated neck provided on a shoulder which is fused to one end of the tube main body to discharge the liquid content to an outside and having an assembly space formed in the neck, and an integrated discharge rod having a discharge passage formed at an upper end of the neck, such that a portion of the discharge passage connected to the assembly space has a large diameter while a portion of the discharge passage connected to the outside has a small diameter, and a plurality of discharge flips formed at a predetermined interval, having elasticity, provided on an inner side surface of the discharge passage having the large diameter, and inclined toward the assembly space, such that the discharge flips move in a discharge direction of the liquid content when a pressure is applied, and return to original positions thereof when the pressure is released so as to discharge a uniform amount of the liquid content; a regulating unit provided in the assembly space to regulate a discharge amount of the liquid content received in the tube main body and discharge the liquid content through the discharge passage, and including a body having a width corresponding to a width of the assembly space, a space portion formed in the body by perforating a bottom surface of the body, and a regulating port provided in the space portion and having a regulating hole having a diameter which is gradually increased from a bottom to a top of the regulating hole toward the discharge passage; and a valve unit provided under the regulating unit so as to be opened when the pressure is applied to the liquid content received in the tube main body, and closed when the pressure is released, and including a fixing member having a top edge making contact with a bottom surface of the regulating unit to support the bottom surface of the regulating unit, including a diaphragm having an exhaust hole which is formed inside the diaphragm and extends upward from a top surface of the diaphragm, and fixed by a fixing protrusion formed on an inner side surface of the neck, and a valve inserted into the fixing member adjacent to the exhaust hole extending upward to open and close the exhaust hole by the pressure, and including a ring member inserted into the fixing member, a blocking film provided on an inner side of the ring member to open and close the exhaust hole by the pressure, a plurality of bridge pieces having an arc shape and connecting the ring member and the blocking film such that the exhaust hole is opened and closed as the blocking film moves up and down by the pressure, and a plurality of outlet holes formed among the bridge pieces, the blocking film, and the ring member, wherein the tube main body, the tube head, the regulating unit, and the valve unit are sequentially assembled.

The discharge flips having a cone shape directed to the assembly space may include flips that move as the pressure is applied and released, and discharge holes formed at centers of the flips to discharge the uniform amount of the liquid content as the flips move.

The discharge holes formed at the centers of the flips may have diameters which are gradually increased toward the assembly space and gradually decreased toward the discharge direction of the liquid content.

According to the present invention, the uniform amount of the liquid content may be discharged in the droplet form through the narrow passage and the wide passage, and then through the wide passage and a narrow passage when the liquid content is discharged in the droplet form in the process of discharging the liquid content through the discharge passage by the pressure applied by the user, so that an appropriate amount of the liquid content, which is considered necessary, can be smoothly used. Particularly, since the external air is not introduced to an inside due to the opening and closing of the discharge passage, the liquid content is prevented from being deteriorated, so that long-term use of the liquid content can be ensured. In addition, the uniform amount of the liquid content can be accurately discharged in the droplet form.

In addition, the liquid content is discharged in a more uniform amount when the liquid content is discharged in the droplet form, so that it is convenient for the user to use an accurate amount of the liquid content.

DETAILED DESCRIPTION OF THE INVENTION

Hereinafter, exemplary embodiments of the present invention will be described in more detail with reference to the accompanying drawings. However, the present invention is not limited to the embodiments.

Figure 1:
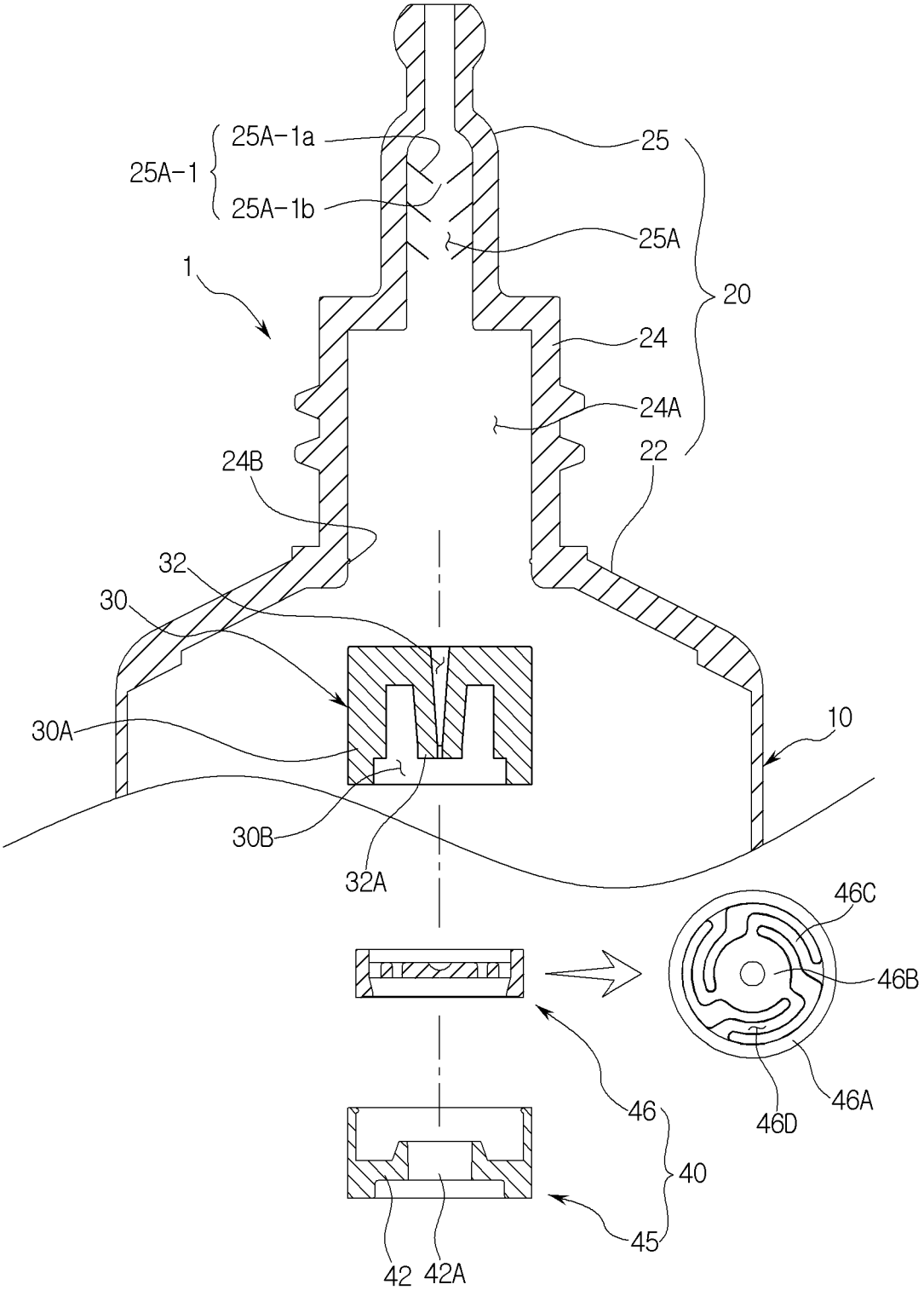
FIG. 1 is an exploded sectional view for describing the present invention.
Figure 2:
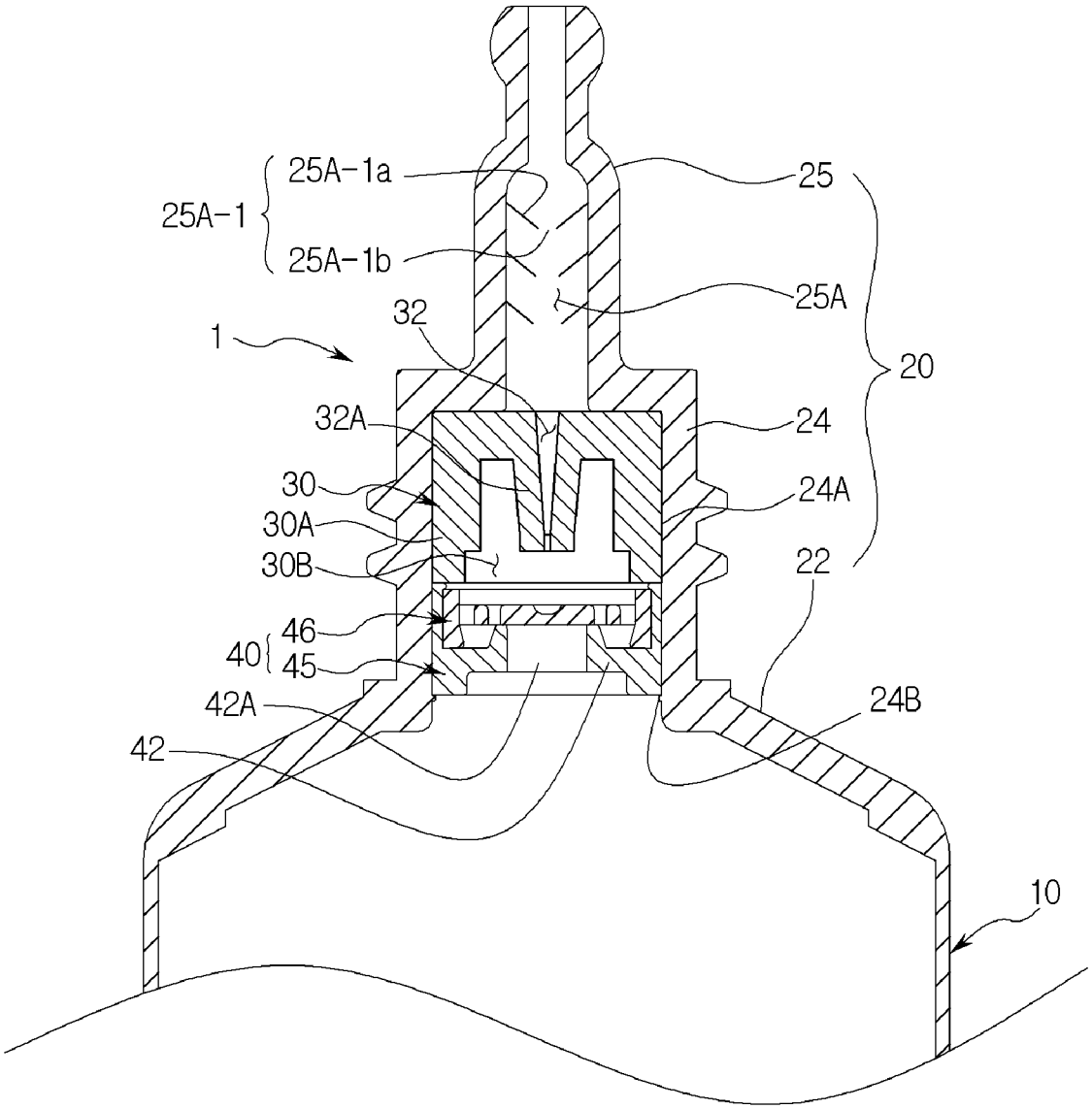
FIG. 2 is a sectional view showing a coupled state of FIG. 1.
Figure 3:
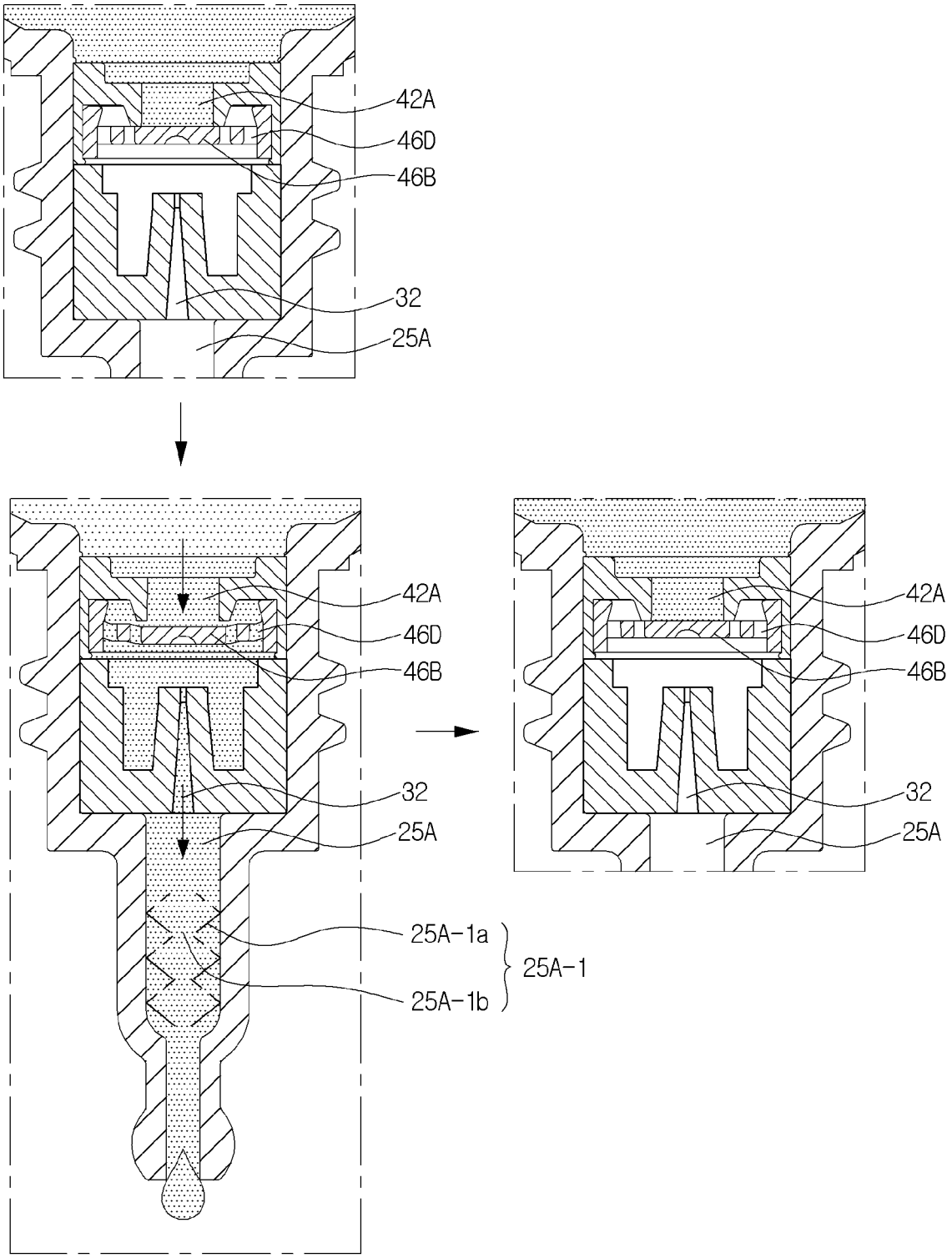
FIG. 3 is a flowchart for describing the use of the present invention.

FIG. 1 is an exploded sectional view for describing the present invention, FIG. 2 is a sectional view showing a coupled state of FIG. 1, and FIG. 3 is a flowchart for describing the use of the present invention.

As shown in the drawings, a discharge device provided in a tube container may discharge and use an appropriate amount of a liquid content filled in the tube container in a droplet form, but not in a stream form, when a pressure is applied.

An object of the present invention is to discharge a uniform amount of the liquid content in the droplet form through a narrow passage and a wide passage, and then through the wide passage and a narrow passage when the liquid content is discharged in the droplet form in a process of discharging the liquid content through a discharge passage by a pressure applied by a user.

A discharge device 1 according to the present invention may be filled with the liquid content, and may include a tube main body 10 fabricated through extrusion or molding by using a typical synthetic resin having flexibility and to which the pressure is easily applied by the user.

In addition, the discharge device 1 may include a tube head 20 including: an integrated neck 24 provided on a shoulder 22 which is fused to one end of the tube main body 10 to discharge the liquid content to an outside and having an assembly space 24A formed in the neck 24; and an integrated discharge rod 25 having a discharge passage 25A formed at an upper end of the neck 24, such that a portion of the discharge passage 25A connected to the assembly space 24A has a large diameter while a portion of the discharge passage 25A connected to the outside has a small diameter. Further, the tube head 20 may be molded by using a synthetic resin through a typical molding scheme, in which the shoulder 22, the neck 24, and the discharge rod 25 are integrally formed, and a lower end of the shoulder 22 is fused to the one end of the tube main body 10 through a typical scheme.

In this case, one of the important technical configurations for discharging a uniform amount of the liquid content when the liquid content is discharged in the droplet form, which is the main technical idea of the present invention, will be proposed.

A plurality of discharge flips 25A-1 having elasticity may be formed at a predetermined interval, provided on an inner side surface of the discharge passage 25A having the large diameter, and inclined toward the assembly space 24A, such that the discharge flips 25A-1 move in a discharge direction of the liquid content when a pressure is applied, and return to original positions thereof when the pressure is released so as to discharge a uniform amount of the liquid content.

In the above configuration, the discharge flips 25A-1 having a cone shape directed to the assembly space 24A may include: flips 25A-1*a* that move as the pressure is applied and released; and discharge holes 25A-1*b* formed at centers of the flips 25A-1*a* to discharge the uniform amount of the liquid content as the flips 25A-1*a* move. The flip preferably has a relatively thin thickness like a thin plate so as to be easily moved even by a small pressure.

In other words, when the liquid content is intended to be discharged in the droplet form, the liquid content may be supplied in an appropriate amount from a regulating unit and a valve unit, which will described below, and a uniform amount of the liquid content may be discharged even when the liquid content is discharged in the droplet form by each of the discharge flips formed at a predetermined interval in the discharge passage which has the large diameter and allows the liquid content to be actually discharged therethrough.

In other words, the liquid content supplied in an appropriate amount through the valve unit and the regulating unit may pass through the discharge passage by the pressure. In this case, the discharge flips formed at a predetermined interval in the discharge passage having the large diameter may be configured such that the flips move in a discharge direction of the liquid content when the pressure is applied so as to push a uniform amount of the liquid content, and return back to original positions thereof before the pressurization by a suction pressure when the pressure is released so as to stop discharging the liquid content that passes through the discharge passage so that the liquid content may no longer be discharged.

Therefore, when the liquid content is discharged in the droplet form, a uniform amount of the liquid content may be accurately discharged at all times.

In addition, the liquid content no longer flows through the discharge passage, so that leakage may be prevented.

Furthermore, the discharge holes 25A-1*b* formed at the centers of the flips 25A-1*a* may have diameters which are gradually increased toward the assembly space 24A in order to allow the liquid content to be smoothly introduced and gradually decreased toward the discharge direction of the liquid content in order to easily block a flow the liquid content.

Accordingly, the liquid content may be discharged through the discharge passage in the droplet form as well as in the uniform amount.

Therefore, it is convenient for the user to discharge and use the liquid content in a more precise amount when the liquid content is used in the droplet form.

In addition, the discharge device 1 may include a regulating unit 30 provided in the assembly space 24A to regulate a discharge amount of the liquid content received in the tube main body 10 and discharge the liquid content through the discharge passage 25A, and having a regulating hole 32 having a diameter which is gradually increased from a bottom of the regulating hole 32 toward the discharge passage 25A. The regulating unit is also molded by using a synthetic resin through a typical molding scheme.

The regulating unit 30 may include: a body 30A having a width corresponding to a width of the assembly space 24A; a space portion 30B formed in the body 30A by perforating a bottom surface of the body 30A; and a regulating port 32A provided in the space portion 30B and having a regulating hole 32 having a diameter which is gradually increased from a bottom to a top of the regulating hole 32 so as to regulate the discharge amount of the liquid content. In this case, a diameter of the regulating hole adjacent to the discharge passage may be smaller than the diameter of the discharge hole.

In other words, the discharge amount of the liquid content in the discharge passage may be regulated by allowing the liquid content to pass from the bottom to the top of the regulating hole having the diameter which is gradually increased from the bottom and the top of the regulating hole. The liquid content supplied to the discharge passage may be retained in the discharge passage, and may drip down in the droplet form by the pressure.

Accordingly, together with the discharge flips formed in the discharge passage having the large diameter, the liquid content may be discharged in the droplet form more smoothly.

In addition, the discharge device 1 may include a valve unit 40 provided under the regulating unit 30 so as to be opened when the pressure is applied to the liquid content received in the tube main body 10, and closed when the pressure is released, wherein the tube main body 10, the tube head 20, the regulating unit 30, and the valve unit 40 may be sequentially assembled.

The valve unit 40 may include: a fixing member 45 having a top edge making contact with a bottom surface of the regulating unit 30 to support the bottom surface of the regulating unit 30, including a diaphragm 42 having an exhaust hole 42A which is formed inside the diaphragm 42 and extends upward from a top surface of the diaphragm 42, and fixed onto an inner side surface of the neck 24; and a valve 46 inserted into the fixing member 45 adjacent to the exhaust hole 42A extending upward to open and close the exhaust hole 42A by the pressure.

The valve 46 may include: a ring member 46A inserted into the fixing member 45; a blocking film 46B provided on an inner side of the ring member 46A to open and close the exhaust hole 42A by the pressure; a plurality of bridge pieces 46C having an arc shape and connecting the ring member 46A and the blocking film 46B such that the exhaust hole 42A is opened and closed as the blocking film 46B moves up and down by the pressure; and a plurality of outlet holes 46D formed among the bridge pieces 46C, the blocking film 46B, and the ring member 46A to allow the liquid content to be discharged through the exhaust hole 42A. The bridge piece preferably has a relatively narrow width so that the blocking film may smoothly move up or down when the pressure is applied or released.

In addition, the fixing member 45 may be inserted into the assembly space 24A and fixed by a fixing protrusion 24B formed on the inner side surface of the neck 24. In other words, as the fixing member is inserted into the assembly space, a lower end of the fixing member is fixedly latched to the fixing protrusion with a clack.

In other words, in the valve unit according to the present invention, when the pressure is applied by the user, the blocking film of the valve may open the exhaust hole of the fixing member by the applied pressure, so that the liquid content may be discharged in the droplet form through the outlet holes, the regulating hole, and the discharge passage.

In particular, when the pressurization is completed, the blocking film of the valve, which has opened the exhaust hole of the fixing member by an internal pressure in the tube main body, may close the exhaust hole again, so that air may be basically prevented from being introduced from the outside.

Accordingly, various bacteria and the like contained in the air may not be introduced into the tube main body which is filled with the liquid content, so that the liquid content may be basically prevented from being deteriorated.

Therefore, since the present invention has a simple structure, but not a complicated technical configuration, and particularly, external air is not introduced to an inside as the exhaust hole is opened and closed, the liquid content is basically prevented from being deteriorated, so that long-term use of the liquid content may be ensured.

What is claimed is:

1. A discharge device for discharging a liquid content in a tube container in a droplet form, the discharge device comprising:

a tube main body having flexibility and configured to contain the liquid content;

a tube head including an integrated neck provided on a shoulder which is connected to one end of the tube main body to discharge the liquid content to an outside and having an assembly space formed in the neck, and an integrated discharge rod having a discharge passage formed at an upper end of the neck, such that a portion of the discharge passage connected to the assembly space has a larger diameter than a portion of the discharge passage connected to the outside, and a plurality of discharge flips having elasticity and provided at predetermined intervals along an inner side surface of the portion of the discharge passage having the large diameter, and inclined toward the assembly space, such that the discharge flips are configured to move in a discharge direction of the liquid content when a pressure is applied, and return to original positions thereof when the pressure is released so as to discharge an amount of the liquid content;

a regulating unit provided in the assembly space to regulate a discharge amount of the liquid content received in the tube main body and discharge the liquid content through the discharge passage, and including a regulating body having a width corresponding to a width of the assembly space, a space portion formed in the body by perforating a bottom surface of the regulating body, and a regulating port provided in the space portion and having a regulating hole having a diameter which is gradually increased from a bottom to a top of the regulating hole toward the discharge passage;

and a valve unit provided under the regulating unit so as to be opened when the pressure is applied to the liquid content received in the tube main body, and closed when the pressure is released, and including a fixing member having a top edge making contact with a bottom surface of the regulating unit to support the bottom surface of the regulating unit, wherein the fixing member includes a diaphragm having an exhaust hole which is formed inside the diaphragm and extends upward from a top surface of the diaphragm, and wherein the fixing member is fixed by a fixing protrusion formed on an inner side surface of the neck, and wherein the valve unit further includes a valve inserted into the fixing member adjacent to the exhaust hole extending upward to open and close the exhaust hole by the pressure, and wherein the valve includes:

a ring member inserted into the fixing member;

a blocking film provided on an inner side of the ring member to open and close the exhaust hole by the pressure;

a plurality of bridge pieces having an arc shape and connecting the ring member and the blocking film such that the exhaust hole is opened and closed as the blocking film moves up and down by the pressure; and a plurality of outlet holes formed among the bridge pieces, the blocking film, and the ring member, wherein the tube main body, the tube head, the regulating unit, and the valve unit are sequentially assembled, and the discharge flips include, a cone shape directed to the assembly space and flips that move as the pressure is applied and released, and discharge holes formed at centers of the flips to discharge the uniform amount of the liquid content as the flips move.

2. The discharge device of claim 1, wherein the discharge holes formed at the centers of the flips respectively have diameters which are respectively gradually increased toward the assembly space and are respectively gradually decreased toward the discharge direction of the liquid content.

* * * * *